United States Patent [19]

Norris et al.

[11] Patent Number: 4,925,740

[45] Date of Patent: May 15, 1990

[54] HOLLOW METAL SPHERE FILLED STABILIZED SKIN STRUCTURES AND METHOD OF MAKING

[75] Inventors: Brian Norris, San Diego; Francis J. Gojny, Bonita, both of Calif.

[73] Assignee: Rohr Industries, Inc., Chula Vista, Calif.

[21] Appl. No.: 386,344

[22] Filed: Jul. 28, 1989

[51] Int. Cl.[5] ..... B22F 3/00

[52] U.S. Cl. ..... 428/547; 428/558; 428/554; 428/570; 428/610; 428/402; 428/403; 419/9

[58] Field of Search ..... 428/547, 558, 554, 570, 428/610, 402, 403; 419/9

[56] References Cited

U.S. PATENT DOCUMENTS

| | | | |
|---|---|---|---|
| 2,602,614 | 7/1952 | Cole | 244/123 |
| 2,985,411 | 5/1961 | Madden, Jr. | 244/123 |
| 3,212,573 | 10/1965 | Valyi | 428/600 |
| 3,773,475 | 11/1973 | Madden, Jr. | 29/192 |
| 4,327,154 | 4/1982 | Rossmann | 428/545 |
| 4,423,097 | 12/1983 | Mons et al. | 427/423 |
| 4,568,389 | 2/1986 | Towbin . | |

*Primary Examiner*—Stephen J. Lechert, Jr.
*Assistant Examiner*—Ngoclan T. Mai
*Attorney, Agent, or Firm*—Patrick J. Schlesinger; Frank D. Gilliam

[57] ABSTRACT

A high strength, light weight stabilized skin structure having spaced skin sheets and a plurality of hollow metal spheres filling the space between the skins. The spheres and skins are bonded together, resulting in a unitary structure. The spheres typically have outside diameters of from about 0.005 to 0.5 inch, with tall thicknesses of about 0.0005 to 0.005 inch. Spheres of different sizes may be used, with smaller or heavier wall thickness spheres in high load areas, such as insert attachment points, and larger spheres in lightly loaded areas. The spheres preferably have a surface coating of a brazing material and are bonded together and to the skins by furnace brazing.

21 Claims, 1 Drawing Sheet

HOLLOW METAL SPHERE FILLED STABILIZED SKIN STRUCTURES AND METHOD OF MAKING

BACKGROUND OF THE INVENTION

This invention relates in general to high strength, light weight structural components and, more specifically, to the manufacture of stabilized skin structures having a plurality of spheres bonded between spaced skin sheets.

High strength, light weight structures are required in many applications, particularly in aircraft and space vehicles. Many such structures have been designed, of widely varying effectiveness and cost.

Isogrid panels, for example, in which a metal plate is machined to produce a panel having a triangular pattern of upstanding ribs and a thin face sheet are very effective. Typical isogrid panels are described in U.S. Pat. No. 4,801,070. The rib pattern can be easily varied in accordance with local area strength requirements. However, these panels are very expensive due to the large amount of metal which must be machined away and the extreme accuracy and care required in the machining operation. Also, they have a skin surface on only one side of the structure.

Honeycomb core panels, large diameter tubular structures and other shapes in which a metal honeycomb sheet is bonded, such as by brazing, between two metal face sheets to form a stabilized skin structure have come into widespread use. Typical of such panels are those described in U.S. Pat. No. 4,716,067. These panels are fairly easy, and only moderately expensive, to manufacture in simple shapes, such as flat or slightly curved panels or large radius tubes. It is, however difficult to meet requirements for local area strengthening of the structure where, for example, connections for other structures must be inserted into the structure. Also, complex shapes are difficult to fabricate as are structures or panels having varying thickness.

Fairly lightweight panels have been made by incorporating lightweight particles, such as vermiculite, glass, plastic or metal microballoons into a plastic matrix and forming structures from the mixture. While these materials may be formed into a variety of complex structures, they tend to be heavy and it is difficult to vary structural strength and weight in different areas. Also, they are not suitable for applications where an all-metal structure is required.

Very small hollow metal microspheres having diameters from about 200 to 10,000 microns have been made as described in U.S. Pat. No. 4,582,534. These microspheres may be fused together or bonded in a glass or resin matrix to produce panels or other structures. While complex shapes can be produced from these materials, the microsphere manufacturing process seems complex and expensive and the strength of panels cannot be easily varied in local areas. Because of the small microsphere diameters, these panels tend to be heavy.

Thus, there is a continuing need for improved panels and other structures which combine light weight, high strength, ease of manufacture, low cost and the ability to easily vary the structural strength in local areas.

SUMMARY OF THE INVENTION

The above-noted problems, and others, are overcome by this invention which basically comprises providing two spaced metal skin sheets, filling the space between the skins with hollow metal spheres having outside diameters of from about 0.005 to 0.5 inch, then bonding the spheres and skin sheets together to form a high strength, light weight structure.

While the spheres may be bonded together and to the skins by sintering in which direct bonding occurs, we prefer to coat the spheres with a very thin layer, typically 0.0001 to 0.002 inch thick, of a brazing material. The wall thickness of the hollow spheres may typically range from about 0.0005 to 0.005 inch. dr

BRIEF DESCRIPTION OF THE DRAWING

Details of the invention, and of certain preferred embodiments thereof, will be further understood upon reference to the drawing, wherein.

DETAILED DESCRIPTION OF PREFERRED EMBODIMENTS

Figure 1:
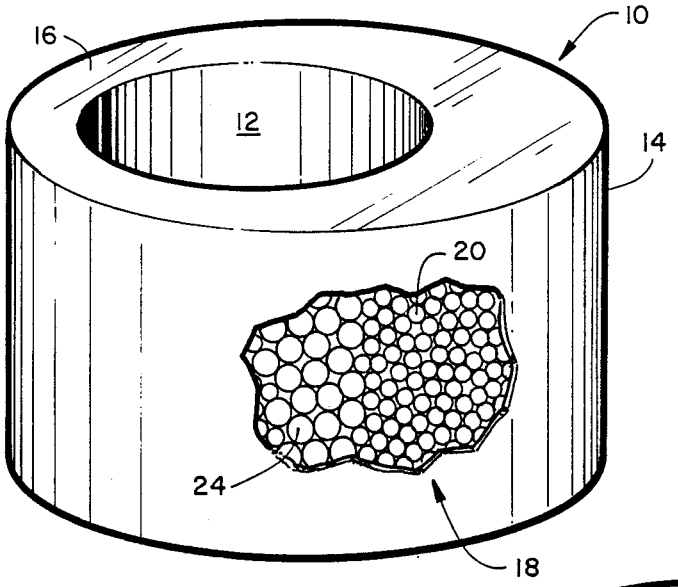
FIG. 1 is a perspective view, partially cut-away, of a tubular structure manufactured according to this invention.
Figure 2:
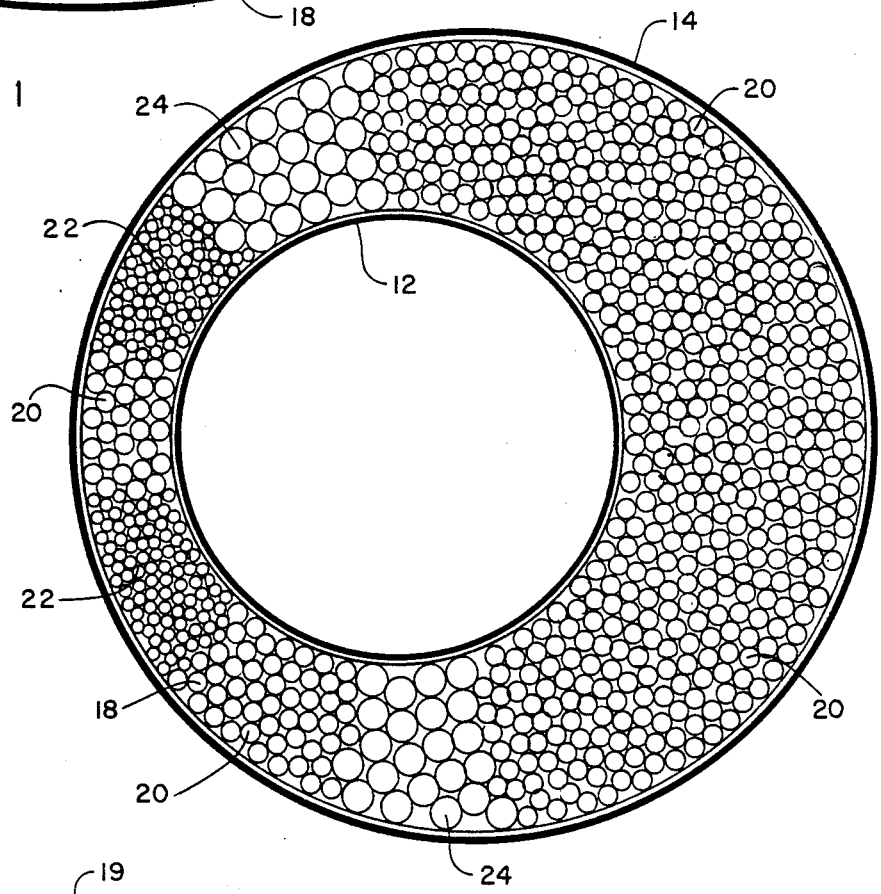
FIG. 2 is a section view through the structure of FIG. 1, taken on line 2—2 in FIG. 1.

Referring now to FIGS. 1 and 2, there is seen a tubular structure 10 which, in this case, has a varying wall thickness. The structure will often be a tube having uniform wall thickness, a flat or slightly curved panel or a more complex shape such as a hemisphere or the like. The non-uniform tube 10 was selected for purposes of illustrating the invention since it more clearly shows the unique ability of this method to produce such non-uniform thickness structures.

Tube 10 in this case includes an inner skin 12, an outer skin 14 and a thin ring-shaped end closure or skin 16. These skins may be formed from any suitable material. Metals such as aluminum, titanium and their alloys are preferred because of their light weight and ability to bond to other metal structures by sintering, bonding, or brazing. Inner skin 12 and outer skin 14 are circular tubes, with the centerline of inner skin 12 offset from the centerline of outer skin 14 to provide an inter-skin space of varying thickness.

The space between inner and outer skins 12 and 14, respectively, is filled with a plurality of hollow metal spheres 18. A portion of the outer skin 14 in FIG. 1 is cut-away to show the spheres 18. The spheres have diameters of from about 0.005 to 0.5 inch. Much smaller spheres add unnecessary weight while much larger spheres reduce the strength of the structure. The spheres may have any suitable wall thickness, typically from about 0.0005 to 0.005 inch. The selection of wall thickness in a particular application is somewhat of a trade-off between the sometimes desirable greater strength of thicker walls and the undesired greater weight of the thicker walls.

Spheres 18 may be formed from any suitable material. For different applications, plastic, glass or metal spheres, or a combination thereof may be used. Metals are preferred for their strength, high temperature resistance and compatibility with other structures when used in aerospace applications. For best results, titanium, Inconel, aluminum, nickel and alloys thereof are preferred. Spheres 18 may be closed, sealed spheres and may be evacuated where an internal vacuum would be desirable in reducing heat transfer across the structure, or they could have various holes or perforations to reduce weight. In most cases, closed air or other gas filled spheres will be used for ease of manufacture.

Tube 10 is assembled by positioning inner skin 12 and outer skin 14 in the desired relationship, filling the space therebetween with the selected hollow spheres 18, adding end closure 16, if used, then bonding the spheres together and to the skins. Any suitable bonding technique may be used. For example, a dry adhesive layer could be provided on the outer surfaces of the spheres. A heat activated adhesive could be activated by heating the assembly, or a solvent activated adhesive could be activated by briefly flushing the inter-skin with a solvent. For best results, however, particularly in aerospace applications, we prefer to use only metals in the structure, bonding the spheres together and to the skins by sintering or by brazing using a thin surface layer of brazing metal on the sphere surfaces. Typically, the brazing metal layer would have a thickness of about 0.0001 to 0.002 inch. While the sides of skins 12 and 14 in contact with spheres 18 could also be coated with the brazing material, we have found that coating the skins is ordinarily not necessary. Any suitable brazing material may be used. We have found that the following combinations of brazing material and sphere material produce excellent results: AMS 4777 braze with Inconel spheres, a 95 wt % zinc, 5 wt % aluminum alloy braze with aluminum, aluminum-lithium or aluminum-iron-lithium spheres; and titanium-copper-nickel brazing material with titanium or titanium-aluminum spheres.

Figure 3:
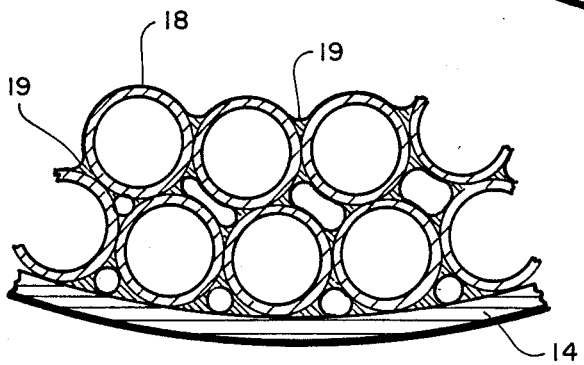
FIG. 3 is an enlarged detail view of a portion of FIG. 2 showing the bonding of spheres and skins.

FIG. 3 illustrates, in an enlarged detail view of an edge portion of the showing in FIG. 2, the assembly after brazing material coated spheres have been heated to the brazing temperature. By capillary action, the liquefied brazing material 19 migrates to the contact points, or near contact points, between spheres and between spheres and skin 14, to form an excellent bond while not unnecessarily increasing overall weight.

One of the primary novel features of this invention is the ability to easily vary the strength to weight ratio of different areas of the structure by using spheres of different diameters, as best seen in FIG. 2. Alternatively (or in addition) different wall thicknesses may be used. For convenience, and best results, especially in the higher stress areas, we prefer different diameters. In regions of the structure bearing average loads, spheres 18 may have an average or medium size 20. In more highly loaded areas, such as where external structures are to be fastened to tube 10, smaller (or greater wall thickness) spheres 22 may be used. In lightly loaded areas, larger (or thinner walled) spheres 14 may be used to save weight.

Where axial bands of spheres of different diameters are desired, elongated strips of metal may be permanently or temporarily inserted radially between the inner and outer skins to define channels to be filled with different sized spheres. After filling, the strips may be withdrawn and the assembly tamped or vibrated to settle the spheres.

Where a local region is to have, for example, smaller sized spheres in a background of medium sized spheres, the interskin space can be filled to the bottom of that region with the medium sized spheres. Strips are inserted to define the radial extent of that region. Filling is continued with the small sized spheres inside and medium sized spheres outside the strip defined region until the top of that region is reached. Then the strips are removed and filling continued with the medium sized spheres. Combinations of these techniques, or other methods, can be used to produce complex structures having a number of regions, bands or axial strips having different strength and weight characteristics.

Certain preferred materials, sizes and arrangements have been specified in conjunction with the above description of preferred embodiments. These can be varied, where suitable, with similar results. For example, other components could be placed among the spheres and bonded to the spheres, such as axial tubes, sensors or the like.

We claim:

1. High strength, light weight, stabilized skin structures which comprise:

two spaced apart metal skins; and a plurality of hollow metal spheres having diameters of from about 0.005 to 0.5 inch substantially filling the space between said metal skins;

said spheres having outside diameters varying from larger diameters in selected low load areas, through medium diameters in selected average load areas to relatively smaller diameters in selected high load areas and said spheres being bonded together at substantially all points of contact between adjacent spheres and between spheres and skins.

2. High strength, light weight, stabilized skin structures which comprise:

two spaced apart metal skins; and a plurality of hollow metal spheres having diameters of from about 0.005 to 0.5 inch substantially filling the space between said metal skins;

said spheres having a wall thickness which varies from relatively thin in selected low load areas through medium thickness in selected average load areas to relatively thick in selected high load areas and being bonded together at substantially all points of contact between adjacent spheres and between spheres and skins.

3. The structure according to claim 1 wherein the wall thickness of said hollow metal spheres is from about 0.005 to 0.0005 inch.

4. The structure according to claim 1 wherein said spheres are formed from a metal selected from the group consisting of titanium, aluminum, Inconel, aluminum-lithium, aluminum-ironlithium, nickel-aluminum and mixtures or alloys thereof.

5. The structure according to claim 1 wherein said spheres are sintered together and to said skins.

6. The structure according to claim 1 wherein said spheres as introduced between said skins have an outer surface coating of a brazing material and said spheres are bonded together and to said skins by brazing.

7. The structure according to claim 6 wherein said coating has a thickness of from about 0.0001 to 0.002 inch.

8. The structure according to claim 6 wherein said coating comprises a material selected from the group consisting of AMS 4777, 95 wt % zinc-5 wt % aluminum and titanium-copper-nickel.

9. The structure according to claim 1 wherein the spacing between said skins varies across said structure.

10. The method of making a high strength, light weight, stabilized skin structure which comprises the steps of:

providing two spaced apart metal skins;

filling the space between said skins with a plurality of hollow metal spheres having outside diameters of from about 0.005 to 0.5 inch, said spheres having different outside diameters in different regions, selected low load regions being filled with relatively large diameter spheres and selected high load regions being filled with relatively small diameter spheres; and bonding said spheres together and to said skins to produce a unity structure.

11. The method according to claim 10 wherein said space is filled with spheres having different wall thicknesses, whereby selected low load regions are filled with spheres having relatively thin walls and selected high load regions are filled with spheres having relatively thick walls.

12. The method according to claim 10 wherein the wall thicknesses of said hollow metal spheres is from about 0.0005 to 0.005 inch.

13. The method according to claim 10 wherein said two spaced metal skins are arranged with the space therebetween varying across the structure.

14. The method according to claim 10 wherein said bonding step is accomplished by sintering.

15. The method according to claim 10 wherein said spheres are formed from a metal selected from the group consisting of titanium, aluminum, Inconel, aluminum-lithium, aluminum-ironlithium, nickel-aluminum and mixtures or alloys thereof.

16. The method according to claim 10 including the further step of closing the opening through which the inter-skin space is filled with spheres with a metal sheet and bonding said sheet to said spheres during said bonding step.

17. The method according to claim 10 further including the step of providing a surface layer of brazing material on the outer surface of said spheres and accomplishing said bonding step by heating the filled skins to the brazing temperature.

18. The method according to claim 17 wherein said coating comprises a material selected from the group consisting of titanium-copper-nickel and 95 wt % zinc 5 wt % aluminum.

19. The method according to claim 17 wherein said coating has a thickness of from about 0.0001 to 0.002 inch.

20. The structure as defined in claim 18 wherein the wall thickness of said hollow metal spheres is from about 0.0005 to 0.005 inch.

21. The method of making a high strength, light weight, stabilized skin structure which comprises the steps of:

providing two spaced apart metal skins;

filling the space between said skins with a plurality of hollow metal spheres having outside diameters of from about 0.005 to 0.5 inch and said spheres having different wall thicknesses, whereby selected low load regions are filled with spheres having relatively thin walls and selected high load regions are filled with spheres having relatively thick walls; and bonding said spheres together and to said skins to produce a unity structure.

* * * * *